United States Patent [19]

Jürgens

[11] Patent Number: 4,873,522

[45] Date of Patent: Oct. 10, 1989

[54] METHOD FOR TRANSMITTING DOWNHOLE DATA IN A REDUCED TIME

[75] Inventor: Rainer Jürgens, Celle, Fed. Rep. of Germany

[73] Assignee: Eastman Christensen Company, Salt Lake City, Utah

[21] Appl. No.: 46,136

[22] Filed: May 4, 1987

[51] Int. Cl.[4] ..... G01V 1/00

[52] U.S. Cl. ..... 340/853; 367/81; 364/422

[58] Field of Search ..... 181/103; 340/853, 860, 340/861; 367/33, 81; 33/304, 308, 312; 73/151, 151.5; 175/40, 45; 166/65.1, 66; 364/421, 422

[56] References Cited

U.S. PATENT DOCUMENTS

| | | | |
|---|---|---|---|
| 3,691,363 | 9/1972 | Armistead | 364/422 |
| 3,771,118 | 11/1973 | Lichte, Jr. et al. | 340/861 X |
| 3,863,203 | 1/1975 | Patton et al. | 175/40 X |
| 4,513,403 | 4/1985 | Troy | 367/83 |
| 4,593,559 | 6/1986 | Brown et al. | 73/151 |
| 4,686,625 | 8/1987 | Bryan | 340/853 X |

OTHER PUBLICATIONS

Hearn, Ed, "How Operators Can Improve Performance of Measurement While Drilling Systems", Oil & Gas Journal, Oct. 1984, pp. 80–84.

*Primary Examiner*—Brian S. Steinberger

*Attorney, Agent, or Firm*—J. A. Walkowski; Daniel L. Dawes

[57] ABSTRACT

A tool face orientation of a directional drill bit within a borehole is efficiently communicated to the well surface by communicating only changes in the tool face orientation. In the first embodiment after the entire tool face orientation is measured and transmitted uphole, and thereafter changes of the tool face orientation as measured with respect to the center of spatially fixed sectorial ranges are transmitted uphole. The magnitude of the changes relative to the center of a fixed sectorial range, being smaller than the range of the entire tool face orientation, allow the subsequent transmission to be made using words of shorter length. Alternatively, the changes in tool face orientation may be measured with respect to a sliding reference point. The sliding reference point may, for example, be the mean value of the prior ten measurements and any previous mean values. The sliding sector will then be held until change in the tool face orientation cause the tool to go out of the sectorial range of the sliding reference point, at which point a new sliding reference is defined which inherently includes the tool face within its range.

18 Claims, 3 Drawing Sheets

FIXED SECTOR SOLUTION

SLIDING SECTOR SOLUTION

METHOD FOR TRANSMITTING DOWNHOLE DATA IN A REDUCED TIME

BACKGROUND OF THE INVENTION

1. Field of the Invention

The invention relates to the field of earth boring tools and more particularly to methodologies for transmitting tool face orientation data within a bore hole.

2. Description of the Prior Art

In order to successfully operate a directional drill it is necessary to know the orientation of the drill bit downhole at all times. The orientation, or angular position of the tool face downhole is sensed by a downhole mechanism, such as gravitational or magnetic sensors and then transmitted to the well platform where the directional drilling procedure is controlled. Transmission is typically through mud pulsing which is relatively slow, particularly compared to electronic communication rates, so that there is a premium placed upon efficiency of the downhole communication technique. In one prior art tool, borehole orientation is communicated uphole in forty-eight bits of information transmitted in straight serial binary form at one second intervals, LICHTE, Jr. et al., "Borehole Orientation Tool", U.S. Pat. 3,771,118 (1973).

The tool face orientation is generally described in angular coordinates, such as borehole inclination and azimuth. Therefore, a plurality of parameters must be transmitted in order to obtain a complete characterization of tool orientation. See, for example, ARMISTEAD, "Borehole Directional Logging", U.S. Pat. No. 3,691,363 (1972).

Therefore, what is needed is a transmission protocol whereby tool face orientation may be efficiently transmitted to the well surface in a manner which is not subject to the defects of the pior art, and which may be transmitted in reduced time.

BRIEF SUMMARY OF THE INVENTION

The invention is a method for reducing transmission time of tool face orientation data in a borehole comprising the steps of transmitting the entire tool face orientation with a communicated word of a fixed bit length, storing the entire tool face orientation, and defining an angular sector and a reference point within the sector for each parameter of the tool face orientation. The method continues with the step of subsequently transmitting tool face orientation within the defined angular sector with a subset of bits of the fixed bit length word to indicate orientation of the tool face within the defined sector relative to the reference point within the sector. As a result, data transmission rates are substantially reduced.

The method further comprises the step of updating the entire tool face orientation when the tool within the borehole is out of range as determined by the defined angular sector, and repeating the steps of storing, defining and subsequently transmitting about a newly defined angular sector.

In one embodiment in the step of defining the angular sector, the angular sector is defined about a fixed angular reference point.

In another embodiment in the step of defining the angular sector, the angular sector is defined about a computed angular reference point.

The computed angular reference point is defined as the mean value of a predetermined number of prior tool face orientation measurements and the previously determined defined computed angular reference point.

In still another embodiment the step of defining the computed angular reference point, the computed angular reference point is defined as the prior measurement of the entire tool face orientation.

In the step of transmitting the entire tool face orientation, the tool face orientation is transmitted in an eight-bit word. The first three bits of the eight-bit word defines a predetermined fixed angular sector and the remaining five bits of the eight-bit word are reserved for a signal angular displacement from the angular center of the predetermined angular sector. Therefore, in the step of subsequently transmitting the tool face orientation, only the five-bit portion of the word is transmitted.

In another embodiment in the step of transmitting the entire tool face orientation, the fixed bit length word is an eight-bit word, and in the step of subsequently transmitting the changes in tool face orientation, four bits of the eight-bit word are transmitted as a signed angular change about the center of the defined angular sector.

In one embodiment in the step of defining the sectorial range, the angular sector is defined about a sliding reference point.

In the one embodiment in the step of defining, the sliding reference point is defined as the mean value of a predetermined number of prior tool face orientation measurements and the previously determined defined sliding reference point.

In another embodiment in the step of defining the sliding reference point, the sliding reference point is defined as the prior measurment of the tool face orientation.

The invention is also characterized as a method for compressing data for transmission of tool face orientations within an earth boring tool positioned downhole within a borehole. The method comprises the steps of measuring a complete downhole tool face orientation. The complete tool face orientation is transmitted uphole. The complete tool face orientation is stored. Only changes in tool face orientation from a calculated measure of the complete tool face orientation is subsequently transmitted. The complete tool face orientation is periodically measured. The steps of transmitting the complete tool face orientation, storing the tool face orientation and subsequently transmitting only changes from a measure of the tool face orientation are repeated. As a result, data compression rates are increased.

The invention and its various embodiments are symbolically depicted in the Tables reproduced below and can better be visualized by turning to the following detailed description.

DETAILED DESCRIPTION OF THE PREFERRED EMBODIMENT

A tool face orientation of a directional drill bit within a borehole is efficiently communicated to the well surface by communicating only changes in the tool face orientation. In the first embodiment after the entire tool face orientation is measured and transmitted uphole, and thereafter changes of the tool face orientation as measured with respect to the center of spatially fixed sectorial ranges are transmitted uphole. The magnitude of the changes relative to the center of a fixed sectorial range, being smaller than the range of the entire tool face orientation, allow the subsequent transmission to be made using words of shorter length. Alternatively, the changes in tool face orientation may be measured with respect to a sliding reference point. The sliding reference point may, for example, be the mean value of the prior ten measurements and any previous mean values. The sliding sector will then be held until change in the tool face orientation cause the tool to go out of the sectorial range of the sliding reference point, at which point a new sliding reference is defined which inherently includes the tool face within its range.

The efficiency of the transmission rate of tool face data is increased by pulsing only changes in the tool face orientation. In the illustrated embodiments, the data changes are transmitted according to a fixed sector solution in the first embodiment, a sliding sector solution as described in a second embodiment, and last measured value solution in a third embodiment.

Figure 1:
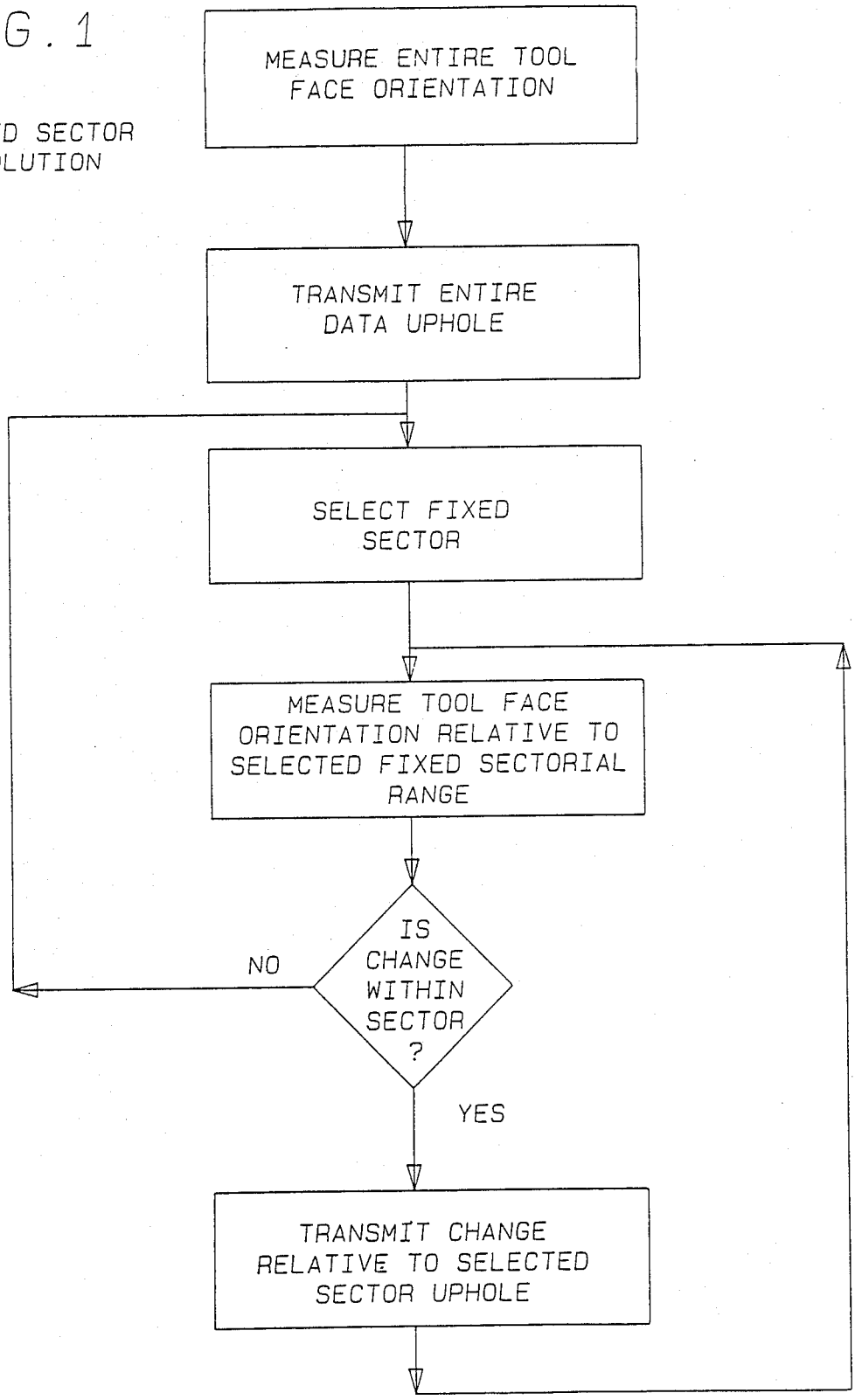
FIG. 1 is a flow diagram depicting the fixed sector solution of the invention in which the range of an angular parameter, taken in the example of FIG. 1 as 0–360 degrees, is divided into fixed sectors of 45 degrees each, with the sector designated by a three-bit number and the point within the sector designated by a five-bit binary number.
Figure 2:
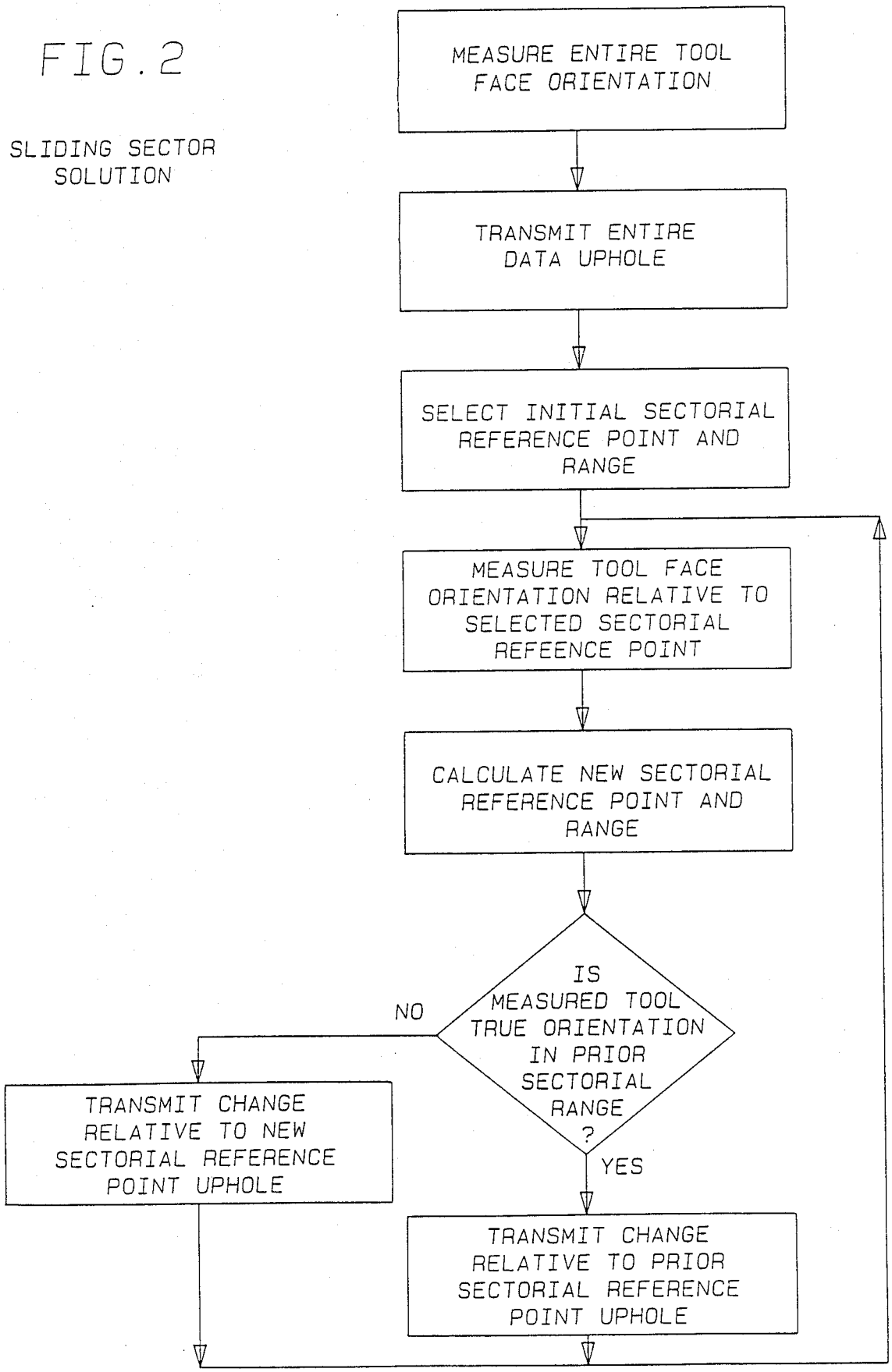
FIG. 2 is a flow diagram depicting another embodiment of the invention designated as the sliding sector solution wherein a predetermined average or measure of an angular parameter of the tool bit orientation is designated by an eight-bit number and thereafter deviations from that predetermined measure are designated by a four-bit binary number.
Figure 3:
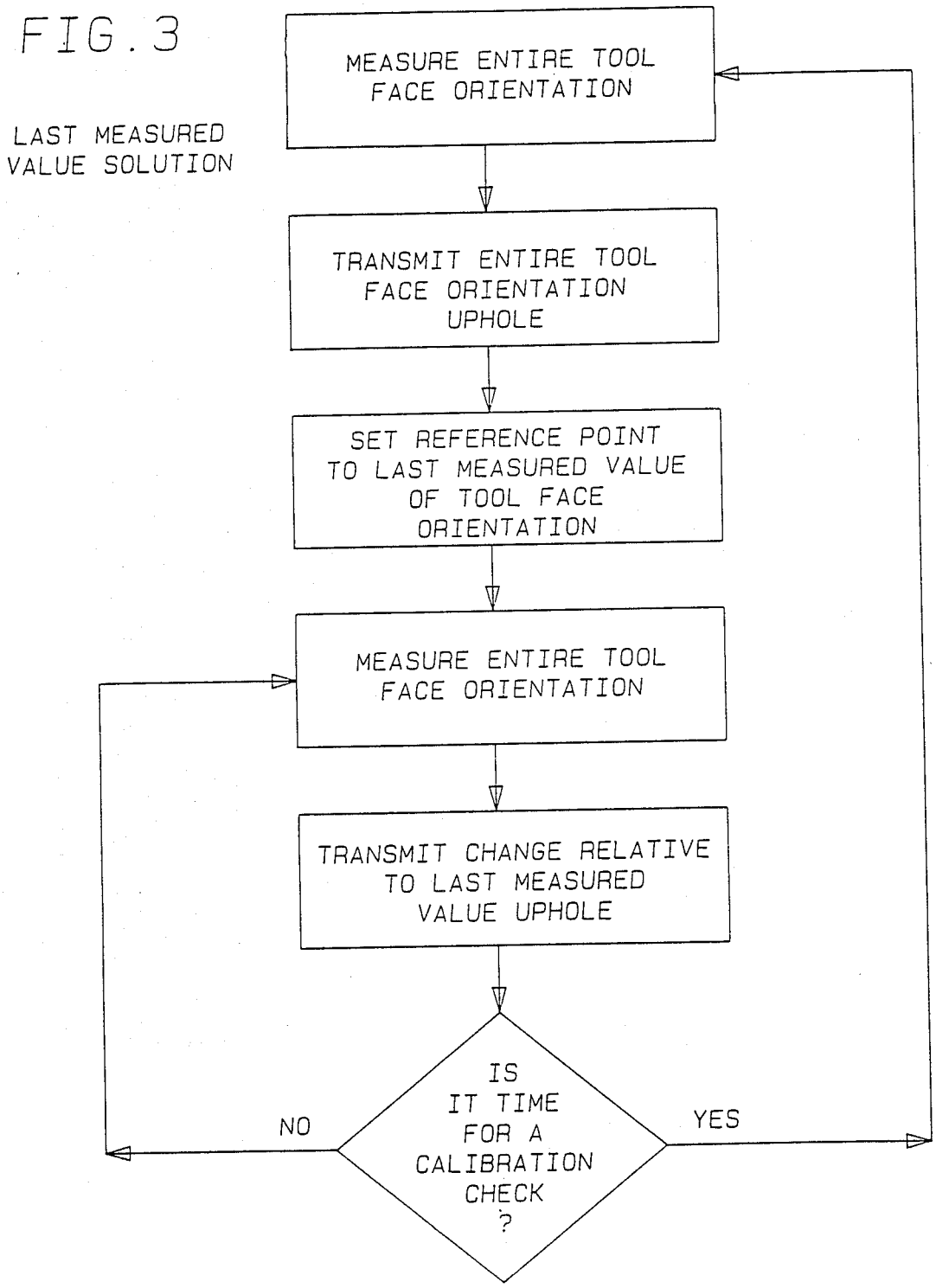
FIG. 3 is a flow diagram of yet another embodiment of the invention designated as the instantaneous sector solution or last measured value solution wherein a sectorial reference point is taken as the last measured value and the deviation therefrom is designated by a word length of less than eight bits, typically a four-bit binary number.

Consider first the fixed sector solution as diagrammatically depicted in FIG. 1 where the measured angle of one of the tool face orientation angular parameters is symbolically denotd by an X on a circular segment between 45 and 90 degrees. The possible range of an angular tool face orientation is, of course, measured by an angular magnitude between zero and 360 degrees. Certain ones of the angular parameters, such as inclination, would of course be confined to smaller ranges, e.g. 0–180. In any case, the range of the angular parameter can be divided into a plurality of fixed sectors. For example, a range of 360 degrees can be divided into eight fixed sectors, namely 0–45 degrees, 45–90 degrees, 90–135 degrees, and so forth.

The first transmission includes pulses, which are transmitted by whichever means may be employed, such as mud pulsing electrical communication or other means now known or later devised, in which the entire tool face orientation for the complete magnitude of each tool face parameter is transmitted. There is of course at this step no efficiency or savings in time. Generally, the pulses will comprise a binary word or words, and each binary word will be comprised of eight bits. Eight bits provides in a 360-degree range a signed angular resolution of plus or minus 2.8 degrees. In other words, an sign bit and seven additional bits can represent a change in a parameter of plus or minus 2.8 degrees.

According to the invention, of the eight bits, three bits are used to define one of the eight sectors in which the tool face is oriented. The remaining five bits are reserved for providing the magnitude of the parameter in the designated sector. Thus, as shown in Table 1 below, the eight-bit word is divided into coded fields so that bits, b8-b6, designate the selected 45-degree sector while bits, b5-b1, designate the angular value of the parameter within the designated sector.

TABLE 1

| b8 b7 b6 | b5 b4 b3 b2 b1 |
|---|---|
| sector | signed parameter magnitude |

On the initial transmission the designated sector is stored in the memory downhole as well as in the surface control unit. It is now possible for the surface control unit and the downhole tool to communicate only in terms of values within the designated sector. In other words communication may thereafter proceed on the basis of transmission of a five-bit word.

At that point, when the tool face moves to an orientation so that it is no longer within the same designated sector, the complete eight-bit value of the word is again transmitted and stored at the well surface and downhole.

The methodology of the first embodiment provides, for example, a 62.5% compression of the data transmission time as compared to transmission with standard eight-bit words. However, when the tool face is close to a sector border and changes in a manner such that the tool face is moving back and forth across the sector boundary, the efficiency of the transmission protocol is substantially degraded since the full eight-bit word must be retransmitted on each occasion that the fixed sector border is crossed.

This disadvantage is avoided by practice of the methodology as described below in connection with the second embodiment which is called the sliding sector solution.

As with the first communication protocol, on the first transmission, the entire value of the tool face orientation is transmitted. However, this value is chosen always to be the mean value of a predetermined number of prior measurements. In the illustrated embodiment the initial transmission is the mean value of the first ten tool face orientation measurements. The full mean value of the first ten measurements is now stored in the well surface controller and in the downhole memory. Thereafter, a smaller number of bits is used to describe a sector centered on the mean value. In the illustrated embodiment four bits are used to described a sector which ranges from plus or minus 21 degrees on each side of the mean value. Table 2 below illustrates the field encoding for each word utilized in the sliding sector solution. In other words, all eight bits are used to communicate the full mean value and only the last four bits are then later reserved for the signed parametric magnitude.

TABLE 2

| b8 b7 b6 b5 | b4 b3 b2 b1 |
|---|---|
| | signed parameter magnitude |
| full mean value | |

Tool orientations continue to be communicated using the four bits as long as the tool is within the plus or minus 21 degree range of the initial mean value. When the tool is out of range, a new mean value is computed.

In the illustrated embodiment, the new mean value is the average of the last ten measurements within the sector plus the old mean value. Many other choices could be utilized to calculate the new mean value without departing from the spirit and scope of the invention. The choice presently illustrated provides a practical selection based upon the rate of change of tool face orientation typically encountered in petroleum directional drilling.

Alternatively, instead of transmitting the angular orientation of the parameter with respect to a calculated sliding mean value, it is also possible according to the invention to transmit only the change in the actual tool face orientation for each parameter as compared to the last measured tool face value. In each case the reference angle, which was previously held fixed at a computed mean value until the tool face was out of range within the predetermined sector, is re-chosen on each measurement as the last measured tool face orientation. This is called an instantaneous sector solution. The angular reference point is effectively changed through deductive computation on each measurement. In such a case the tool face will as a practical matter never be out of sector range and theoretically the complete tool face orientation need not ever by transmitted again.

However, due to measurement errors in the orientational equipment as well as in the lack of infinitely precise resolution due to the use of a data word of finite bit length, it is necessary to periodically retransmit the entire tool face orientation for reconfirmation or adjustment. In the illustrated embodiment regardless of whether a fixed sector solution, sliding selector solution or an instantaneous sector solution is utilized the entire tool face orientation is retransmitted at least every ten minutes.

Many modifications and alterations may be made by those having ordinary skill in the art without departing from the spirit and scope of the present invention. The illustrated embodiments should therefore be understood as set forth only for the purposes of example and should not be taken as limiting the invention as defined in the following claims.

I claim:

1. A method for reducing transmission time of a parameter value of downhole data from a downhole location to a remote location of a well bore comprising:

(a) defining a value of said parameter in said well bore a first time;

(b) representing said value as a range of values and a position within said range;

(c) transmitting said value representation from said downhole location to said remote location at a fixed rate;

(d) storing said range representation at both said downhole and remote locations;

(e) measuring a value of said parameter in said well bore;

(f) determining if said measured value falls within the stored range; and (g) (1) if yes, transmitting only said position within said stored range of said measured value from said downhole location to said remote location at a fixed rate; or (2) if no, selecting a new range and representing said measured value as said new range and a position therewithin and transmitting said new range and position within range from said downhole location to said remote location at a fixed rate and thereafter storing said new range at both locations in lieu of the previously-stored range and (i) repeating steps (e), (f) and (g).

2. The method of claim 1, wherein:

in step (b), said range of values comprises a range in which said defined value is centered; and in step (g)(2), said new range comprises a range in which said value measured in step (e) is centered.

3. The method of claim 2, wherein said values are represented as binary coded words comprising a first fixed plurality of bits defining a range and a second fixed plurality of bits defining a position within range.

4. The method of claim 2, wherein said parameter is an angular parameter, and said values and ranges are expressed in degrees of arc.

5. The method of claim 1, wherein:

in step (a), defining comprises measuring a value of said parameter in said well bore a first time.

6. The method of claim 5, wherein:

in step (b), said range of values comprises a range in which said defined value is centered; and in step (g)(2), said new range comprises a range in which said value measured in step (3) is centered.

7. The method of claim 6, wherein said values are represented as binary coded words comprising a first fixed plurality of bits defining a range and a second fixed plurality of bits defining a position within range.

8. The method of claim 6, wherein said parameter is an angular parameter, and said values and ranges are expressed in degrees of arc.

9. The method of claim 5, wherein said values are represented as binary coded words comprising a first fixed plurality of bits defining a range and a second fixed plurality of bits defining a position within range.

10. The method of claim 5, wherein said parameter is an angular parameter, and said values and ranges are expressed in degrees of arc.

11. The method of claim 1, wherein:

in step (a), defining comprises measuring values of said parameter in said well bore a fixed plurality of times and taking the mean of said plurality of measured values; and in step (g)(1), said new range is selected by taking a new mean of a fixed plurality of previously-measured values and the previous mean value.

12. The method of claim 11, wherein:

in step (b), said range of values comprises a range in which said defined value is centered; and in step (g)(2), said new range comprises a range in which said new mean is centered.

13. The method of claim 12, wherein said values are represented as binary coded words comprising a first fixed plurality of bits defining a range and a second fixed plurality of bits defining a position within range.

14. The method of claim 12, wherein said parameter is an angular parameter, and said values and ranges are expressed in degrees of arc.

15. The method of claim 11, wherein said values are represented as binary coded words comprising a first fixed plurality of bits defining a range and a second fixed plurality of bits defining a position within range.

16. The method of claim 11, wherein said parameter is an angular parameter, and said values and ranges are expressed in degrees of arc.

17. The method of claim 1, wherein said values are represented as binary coded words comprising a first fixed plurality of bits defining a range and a second fixed plurality of bits defining a position within range.

18. The method of claim 1, wherein said parameter is an angular parameter, and said values and ranges are expressed in degrees of arc.

* * * * *